United States Patent [19]

Pinto et al.

[11] Patent Number: 4,780,933

[45] Date of Patent: Nov. 1, 1988

[54] APPARATUS FOR REDUCING FIBER BALES OF SPINNING MATERIAL

[75] Inventors: Akiva Pinto, Gastonia, N.C.; Guenter Lucassen, Haltern; Reinhard Schmidt, Gescher, both of Fed. Rep. of Germany

[73] Assignee: Hergeth Hollingsworth GmbH, Duelmen, Fed. Rep. of Germany

[21] Appl. No.: 89,115

[22] Filed: Aug. 25, 1987

[30] Foreign Application Priority Data

Sep. 19, 1986 [DE] Fed. Rep. of Germany ..... 3631902

[51] Int. Cl.[4] ..... D01G 7/06

[52] U.S. Cl. ..... 19/80 R; 19/81

[58] Field of Search ..... 19/80 R, 81

[56] References Cited

U.S. PATENT DOCUMENTS 3,736,624 6/1973 Alt et al. ..... 19/80 R
4,297,767 11/1981 Leifeld ..... 19/80 R
4,477,944 10/1984 Binder et al. ..... 19/80 R
4,623,099 11/1986 Vos Bein et al. ..... 19/80 R
4,660,257 4/1987 Binder et al. ..... 19/80 R

*Primary Examiner*—Louis K. Rimrodt
*Attorney, Agent, or Firm*—Cort Flint

[57] ABSTRACT

An apparatus for reducing pressed fiber bales arranged in a row is disclosed which facilitates removal of fibers from the upper surface of the bales adjacent a stationary member (28). Transversely extending rollers (18, 19) parallel to milling rollers (4, 5) are provided with blocking means (25, 26). These blocking means may be actuated to prevent rotation of rollers (18, 19). As rollers (18, 19) are carried by housing (2) so as to extend slightly beyond the housing in the direction of travel (16). Upon reaching stationary member (28), blocking means prevents rotation of roller (19). The teeth of roller (19) act as a rake to remove fibers from bale (**24*a*) adjacent stationary member (28) as reducing means (1) starts its travel in the return direction. In this manner, the fibers from the entire upper surface of bale (24**) are more totally and uniformly removed.

12 Claims, 3 Drawing Sheets

APPARATUS FOR REDUCING FIBER BALES OF SPINNING MATERIAL

BACKGROUND OF THE INVENTION

The invention relates to an apparatus for reducing fiber bales, in particular, hard-pressed fiber bales, e.g. of cotton, synthetic fibers, and the like. A reducer reciprocates over the surface of a bale or row of bales, e.g. a milling device comprising rollers drivable paraxially to both sides of the reducer. The rollers have a toothed circumference to engage the bale surface, the reduced material being carried off mechanically or pneumatically.

According to German Pat. No. 81 277, the contemplated bale breaker includes a reducing means which consists of two milling rollers rotating in opposite senses having a corresponding further open roller. Each pair of rollers disposed laterally relative to the central plane of the reducing means rotates in the same sense, while the removed material is removed at the center of the reducing means.

According to German Pat. No. 28 19 292, a device for opening textile fiber bales has been known which comprises a reducing means with at least two conveyer rollers. The rollers move the material intermediate them to an opening roller in a higher position from which the material is transported to a channel. At least part of the uppermost layer of the fiber bale is displaced by at least two conveyer rollers and subsequently fed to the opening member. This is achieved by placing the reducing means approximately centrally onto a fiber bale, and upon a given time, lifting it from the treated fiber bale. Then, the reducing means is moved on to the next fiber bale and lowered there for treatment. This operation is rather complicated for working down a row of bales. If a fiber bale is set up freely, no thrust forces may act on it from the outside or it may tilt over.

It is an object of the present invention to provide a reducing means for removing material by reciprocating over a row of bales in which reducing of the uppermost layer of a bale is improved and facilitate, particularly in the case where the end bale may be adjacent a stationary member like a wall.

SUMMARY OF THE INVENTION

The invention is characterized in that transverse rollers carried laterally by the reducing means are provided with a blocking device for stopping their rotation. It is possible to independently block the rotation of the rollers and separately drive them. Due to this provision and configuration, the total surface of a bale set up at a wall may be reliably reduced. When the reducing means reaches a prescribed proximity to the wall, the horizontal movement of the reducer is terminated and it is guided in a reverse direction. The lateral roller adjacent the wall is blocked against rotation. The blocked roller acts as a rake during the return or reverse travel of the reducer. The respective roller being toothed, the fiber material of the upper layer is raked and entrained over a predetermined distance of the bale from the wall, whereupon the blocking device is deactuated so that the roller may operate normally again. Since the roller acts as a rake, it is ensured that the end bale standing near the wall or the like is reduced just like the other fiber bales in the row intermediate the end bales.

The blocking device for the laterally disposed rollers may be designed in different ways. Blocking may be provided by the direct stopping of the gear motor for the roller. It is also possible to provide a conventional braking device mounted at the shaft between the motor and roller. Preferably, the rollers project laterally in the travel direction of the reducing means and beyond the housing for the reducing means. In this way, the roller to be blocked may be moved as closely as possible to the wall where the bale to be reduced is set up. A scanning device may determine the position to stop the reciprocating movement of the reducing device. The scanning device may be a light barrier or sensor unit. The travel movement of the reducer may be also stopped by limit switches, or by a distance measuring device, etc.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
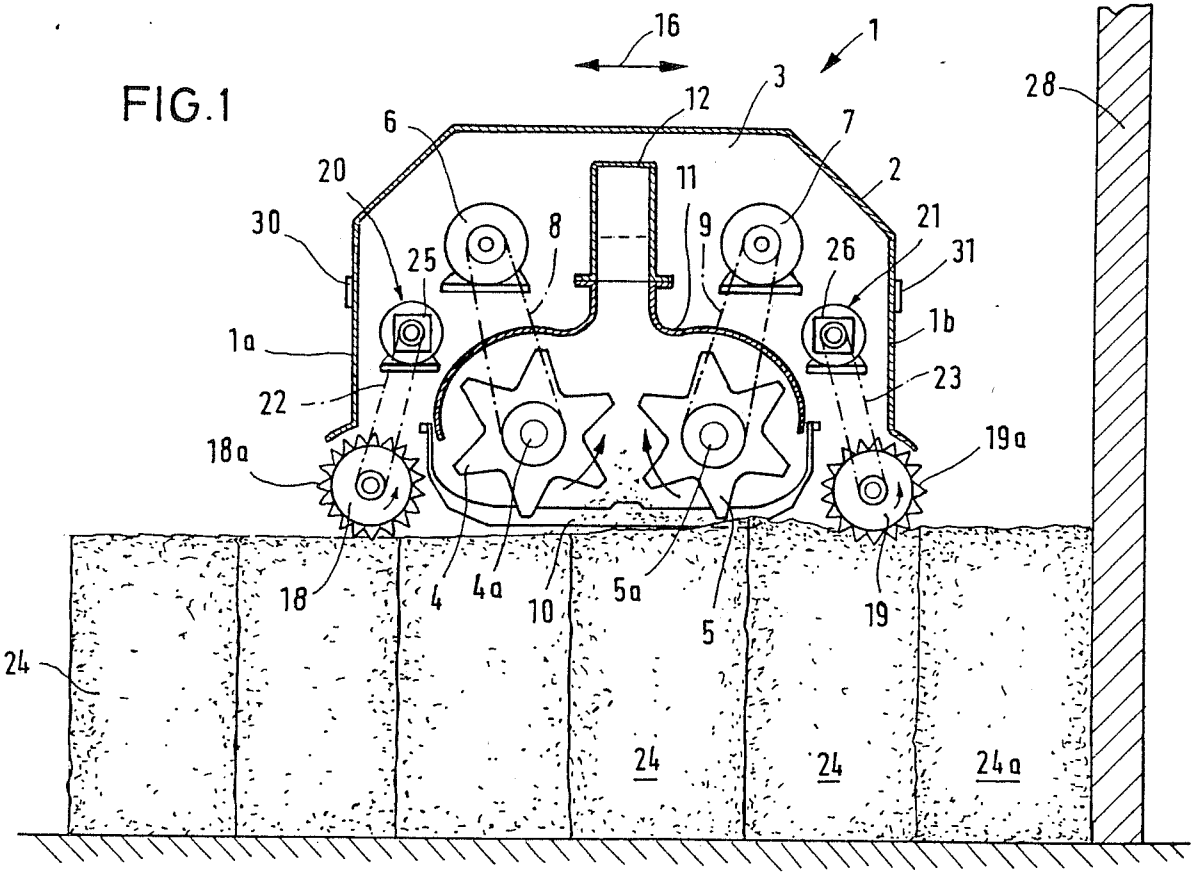
FIG. 1 is a schematic front elevation of an embodiment of the reducing means of the invention.
Figure 2:
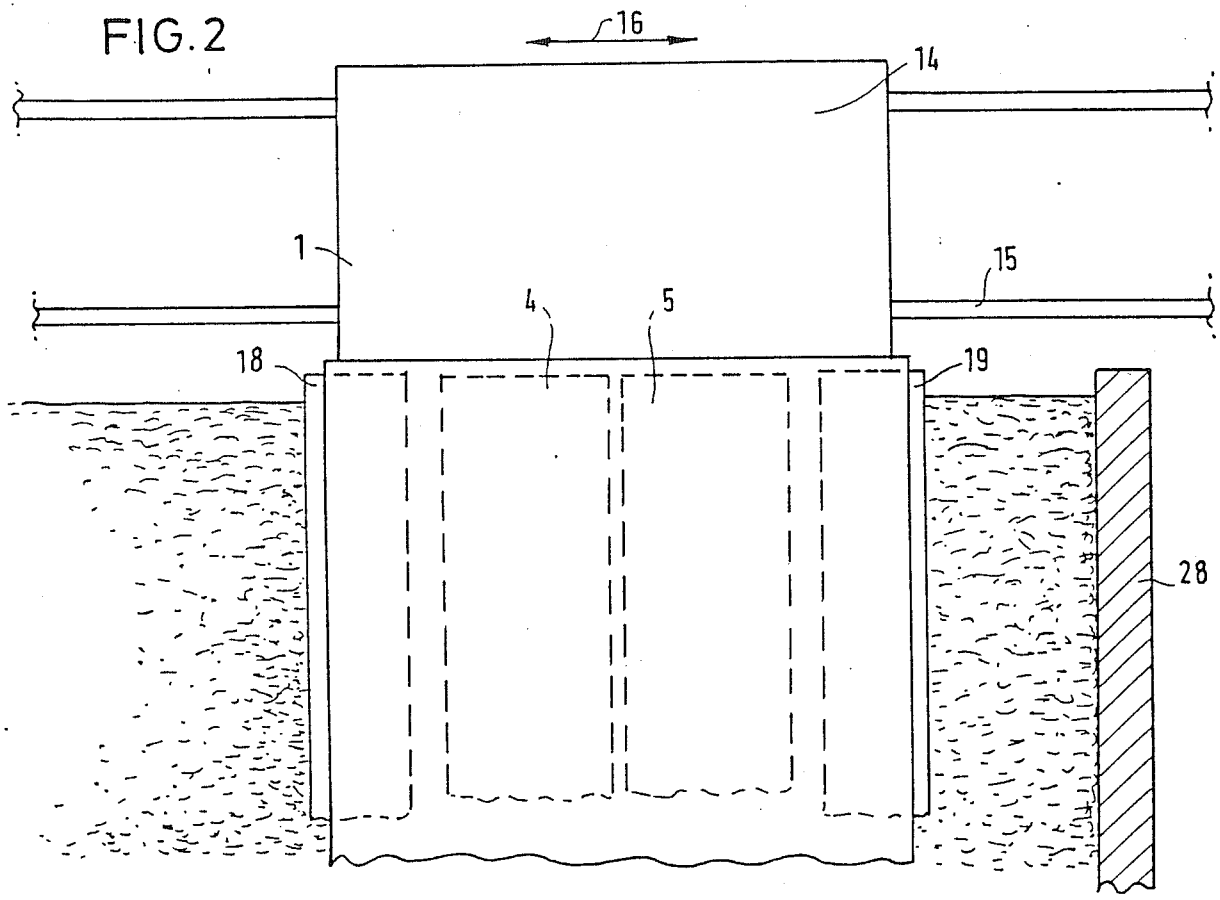
FIG. 2 being a schematic top plan view of part of the reducing means of FIG. 1.

A reducing means 1 comprises a housing 2 in the form of a hood which contains end walls 3. The housing accommodates a milling device which includes opening rollers 4 and 5 which, with respect to the center length plane, rotate oppositely to each other. Motors 6 and 7 which may be secured to the rear end wall 3 of the housing drive rollers 4 and 5. Shafts **4*a* and 5*a* of the opening rollers are driven by means of transmission members 8 and 9. The points of the opening rollers engage through the interspace of a grid 10. The opening rollers 4 and 5 are provided with a cover 11 that extends to a channel 12** through which the removed fiber material is sucked off.

It is possible to fix housing 1 as a projecting cantilever to a tower 14 that may be reciprocated on rails 15 in direction of arrow 16 along a row of bales.

Housing 1 carries transverse rollers 18 and 19 parallel to the axes (paraxially) of opening rollers 4 and 5. Rollers 18 and 20 are driven by motors 20 and 21 via transmission members 22 and 23. Rollers 18 and 19 rotate each in the same sense as the adjacent opening roller. Rollers 4 and 18 rotate counterclockwise, while rollers 5 and 19 rotate clockwise. The circumferential surface of rollers 18 and 19 is rough with teeth provided with points 18a and 19a penetrating into the fiber material of bales 24 of the set up bale row. Preferably, the rollers are coated with saw tooth wire. Rollers 18 and 19 may engage the fiber bales 24 somewhat more deeply than opening rollers 4 and 5.

Each roller 18 and 19 is provided with an independent blocking means 25 or 26 adapted to stop roller 18 and 19 and to block it against rotation. While such a blocking means may be a braking device, blocking may be also realized by stopping a gear motor. Preferably, housing 1 is of a design in which the longitudinal walls 1*a* and 1*b* are set back with respect to the operation circle of rollers 18 and 19 thus allowing for the circumferential surfaces of rollers 18 and 19 to freely project at the sides of housing 1.

The possible blocking of the rotation of rollers 18 or 19 is important. One end of a bal row 24 may be situated at a stationary wall 28, a pillar, and the like stationary member. With the respective bale 24a close to wall 28, it is difficult to reduce the bale surface of marginal bale 24 in the same manner as all the other bales of the row. If the travel direction is reversed, the reciprocating reducing means 1 cannot be moved closely to wall 28, or the like, for safety's sake. Normally, the reduction of marginal bale 24*a* would be completely uncontrolled. To permit a reduction of bale 24*a* during the continuous reciprocating movement of the reducing means, use is made of blocking means 25 and 26 for rollers 18 and 19. The horizontal movement of reducing means 1 is terminated shortly before reaching stationary wall 28 or other obstacle, whereupon by disconnecting the respective motor, the rotation of the corresponding roller 18 or 19 is interrupted. At the same time, the blocking means for the corresponding roller will be effective so that, as shown in the embodiment of FIG. 1, roller 19 will be blocked against rotation. Now, the reducing means is moved horizontally in an opposite direction and away from wall 28. At that occasion, blocked roller 19 acts as a stationary toothed roller like a rake. The stationary roller rakes the uppermost layer of fibers for removal on the return movement of the reducing means.

The fiber layers of the bales have some coherence, e.g. by matting together. The respective uppermost layer is removed over the total fiber bale width by the raking effect of the blocked outer transverse roller of the reducing means. The travel path of the reducing means 1 which entrains the layer material from the marginal bale is about 200 to 300 mm. Subsequently, blocking of the rotary movement of the blocked roller is released. In the instant example, roller 19 is rotating again by the associated drive 21 and in accordance with the horizontal movement of the reducing means 1. During the return movement of the latter, the entrained layer is overtravelled, opened by the external roller and the opening rollers 4 and 5 and carried off through suction channel 12. As soon as the reducing means has been again approached closely enough to wall of obstacle 28, the blocking of the corresponding external rollers may be repeated for the raking effect of the respective roller. Then, over a predetermined distance, the next fiber layer will be raked away from the wall or obstacle, whereupon the stopped rollers may be caused to rotate again.

The approaching of the reducing means 1 to wall 28 may be limited automatically. The position where horizontal movement of the reducing means is stopped may be determined by a scanning means 30, or 31 which may be a light barrier, a sensor assembly, a limit switch unit or a distance measuring device.

Figure 3:
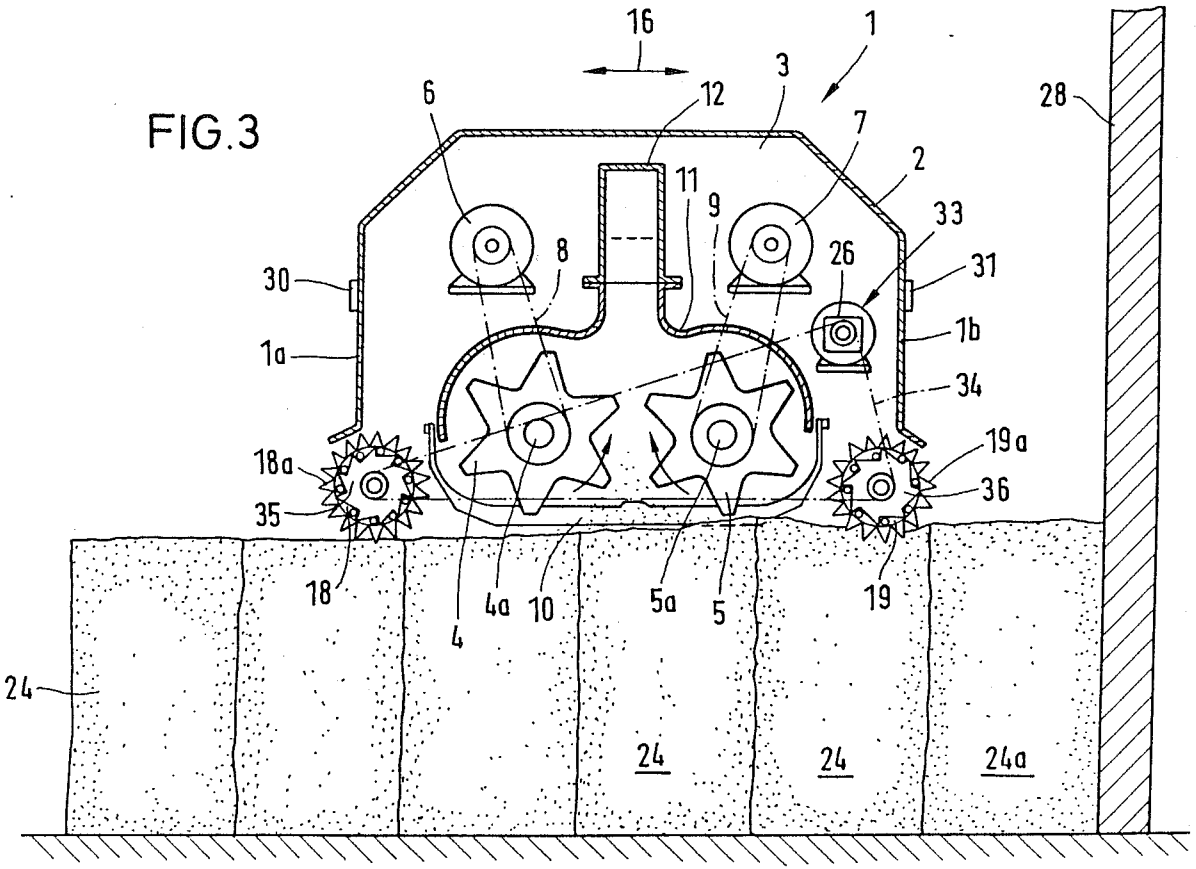
FIG. 3 is a schematic front elevation of another embodiment of the reducing device according to FIG. 1.

In the example of FIG. 1, each roller 18 and 19 is provided with a driving motor 20 and 21 of its own. Rollers 18 and 19 may be also driven by a common motor 33 (FIG. 3) by means of a common transmission member 34. Each roller 18 and 19 is fitted with a free running drive 35 and 36 and the locking or release effect of one free-running drive 35 is opposite to that of the other free-running drive 36. If the free-running drive 36 and the roller 36 are blocked, roller 18 is released for rotation and vice versa, when the travel movement of the reducing means 1 is directed to the opposite sense.

While a preferred embodiment of the invention has been described using specific terms, such description is for illustrative purposes only, and it is to be understood that changes and variations may be made without departing from the spirit or scope of the following claims.

What is claimed is:

1. Apparatus for reducing pressed fiber bales of cotton, synthetic fibers and the like, by a reducing means reciprocating over the surface of the bales having a milling device carried within a housing, outer rollers carried by said housing adjacent opposing sides of said milling device said rollers having a toothed circumference to engage the bale surface, and means for carrying off removed material from said reducing means, wherein said apparatus comprises:

blocking means operatively connected to said outer rollers for preventing rotation of said outer rollers; and said blocking means being operable to independently for stop rotation of said outer rollers.

2. Apparatus according to claim 1 wherein said blocking means includes a braking device for braking a shaft of the outer rollers.

3. Apparatus according to claim 1 wherein said blocking means includes a gear motor for driving said outer rollers; and means for stopping said gear motor so that said outer rollers are stopped by locked gears.

4. The apparatus according to claim 1 wherein said outer rollers are carried by said housing in a manner that they project laterally beyond said housing in the direction of travel of said reducing means.

5. Apparatus according to claim 1 including sensor means for detecting the position of said housing for limiting its travel movement.

6. The apparatus of claim 1 including a drive motor commonly connected to said outer rollers for driving said rollers in common; and a free-running drive carried by said rollers connected to said common drive having a blocking direction which independently blocks rotation of said rollers, and said blocking directions are opposite for said rollers.

7. Apparatus for reducing pressed fiber bales of cotton and the like fibers of the type which includes a reciprocating reducing means which reciprocates over the surface of bales arranged in a row, said reducing means including a milling device for removing fibers from the surface of said bales; and means for conveying said removed fibers from said reducing means wherein the improvement comprises;

(a) transverse rollers carried by said housing parallel to and on opposing sides of said milling device;

(b) blocking means for preventing the rotation of said transverse rollers independently of one another;

(c) said transverse rollers being carried by said housing adjacent said bale surface in a manner that teeth of said transverse rollers extend laterally of said housing so the transverse rollers may approach a stationary member against which a bale at the end of said row abuts; and (d) said blocking means preventing the rotation of said roller upon approaching said stationary member in a manner that said blocked roller acts as a rake to remove fibers upon movement of said reducing means in a return direction.

8. The apparatus of claim 7 including means for sensing the position of said reducing means to limit travel and for actuating said blocking means to prevent rotation of said transverse roller.

9. Apparatus according to claim 7 wherein said blocking means includes a braking device for braking a shaft of the rollers.

10. Apparatus according to claim 7 wherein said blocking means includes a gear motor for driving said rollers; and means for stopping said gear motor so that said rollers are stopped by locked gears.

11. The apparatus according to claim 7 wherein said rollers are carried by said housing in a manner that they project laterally beyond said housing in the direction of travel of said reducing means.

12. The apparatus of claim 7 including a drive motor commonly connected to said rollers for driving said rollers in common; and a free-running drive carried by each roller connected to said common drive having a locking direction which blocks rotation of said roller and said blocking directions are opposite for said rollers.

* * * * *